United States Patent [19]

Kinoshita et al.

[11] Patent Number: 5,040,022

[45] Date of Patent: Aug. 13, 1991

[54] TEMPERATURE CONTROL FOR A FIXING APPARATUS

[75] Inventors: Naohisa Kinoshita; Hiroyuki Kashima; Makoto Hasegawa, all of Nagoya; Toshihiro Tsuzuki, Kariya; Kiyoshi Muto, Yokkaichi, all of Japan

[73] Assignee: Brother Kogyo Kabushiki Kaisha, Japan

[21] Appl. No.: 570,622

[22] Filed: Aug. 21, 1990

[30] Foreign Application Priority Data

Oct. 26, 1989 [JP] Japan ..... 1-125284[U]
Oct. 26, 1989 [JP] Japan ..... 1-125285[U]

[51] Int. Cl.[5] ..... G03G 21/00; G03G 15/20
[52] U.S. Cl. ..... 355/206; 355/285
[58] Field of Search ..... 355/282, 285, 206, 208; 219/469, 216

[56] References Cited

U.S. PATENT DOCUMENTS

| | | | |
|---|---|---|---|
| 3,452,181 | 6/1969 | Stryjewski | 355/285 |
| 4,163,892 | 8/1979 | Komatsu et al. | 219/469 |
| 4,549,803 | 10/1985 | Ohno et al. | 355/285 X |
| 4,603,245 | 6/1986 | Yagasaki | 355/285 |
| 4,745,436 | 5/1988 | Matsuura | 355/206 |
| 4,897,696 | 1/1990 | Matsumoto | 355/285 |
| 4,952,781 | 8/1990 | Kozaiku | 219/469 |

FOREIGN PATENT DOCUMENTS

| | | |
|---|---|---|
| 0011978 | 1/1983 | Japan . |
| 0034576 | 2/1984 | Japan . |
| 0279380 | 12/1987 | Japan . |

*Primary Examiner*—A. T. Grimley
*Assistant Examiner*—Nestor R. Ramirez
*Attorney, Agent, or Firm*—Oliff & Berridge

[57] ABSTRACT

Disclosed is a fixing apparatus wherein a print medium having an image transferred thereto is conveyed by rollers provided with a heat source, whereby the transferred image is fixed to the print medium. At least one of the fixing rollers has a hollow section in which the heat source is disposed toward the side at which the print medium is held and upstream with regard to the direction of rotation of the roller. The fixing apparatus comprises a detector for detecting the temperature at or in the vicinity of the heat source; an operating circuit for operating the heat source when the detected temperature is lower than a required temperature; a device for notifying an operator that the temperature of the fixing apparatus has reached a temperature required for the fixing operation; and a timer which starts to count from the start of operation of the heat source. When the required temperature is reached, the timer is reset, and when operation of the heat source is restarted, the timer starts to count again. The notification by the notifying device is continued regardless of the temperature, and is stopped when the count of the timer reaches a predetermined value.

9 Claims, 5 Drawing Sheets

TEMPERATURE CONTROL FOR A FIXING APPARATUS

BACKGROUND OF THE INVENTION

1. Field of the Invention

The present invention relates to a fixing apparatus having a roller and a heat source, wherein a print medium to which an image has been transferred is held and conveyed by the roller to thereby fix the transferred image to the print medium with pressure and heat.

2. Description of the Related Art

In a conventional fixing apparatus having a roller with a heat source disposed therein, the heat source is positioned at the center of the roller, and heat radiated from the heat source is conducted from the inside of the roller toward the peripheral surface thereof. Accordingly, due to the conducted heat and a holding pressure generated between the roller and another roller associated therewith, the transferred image is fixed to the print medium.

This type of fixing apparatus has a defect in that, when the heat source positioned at the center of the roller starts to radiate heat, the temperature of the roller at the peripheral surface thereof cannot immediately rise to the temperature required for the fixing operation, and accordingly, a certain time must elapse before the fixing operation can be performed. Further, the heat radiated from the center of the roller heats the entire peripheral surface thereof to a constant temperature, regardless of the part of the surface first engaged in the fixing operation. Namely, the heat radiated from the heat source is dispersed throughout the roller, and thus it is not possible to start the fixing operation until a certain time has lapsed, which is uneconomical from the standpoint of time and energy consumption.

Furthermore, when the heat source is switched on, the temperature at a heating unit used for the fixing operation does not immediately rise to a temperature required for the fixing operation. Accordingly, a certain lapse of time must occur before the temperature required for the fixing operation after the heat source is switched on. Consequently, a warning lamp or the like must be lit to inform an operator that the temperature at the heating unit has risen to the temperature required for the fixing operation.

The heating unit temperature required to carry out the fixing operation without malfunctions is usually set within a certain range. Namely, overheating of the heating unit must be prevented, and therefore, the heat source is alternately switched on and off to maintain the temperature of the heating unit within a range required for the fixing operation.

In this case, however, if a reference temperature at which the warning lamp notifying the operator of the temperature of the heating unit is switched on or off is set at the same temperature as that at which the heat source is switched on or off, this will cause problems in that the lamp is repeatedly switched on and off regardless of whether or not the temperature at the heating unit is within the range required for the fixing operation. Therefore, a temperature completely different from the reference temperature at which the heat source is switched on or off must be set as the reference temperature at which the warning lamp is switched on and off.

In the conventional fixing apparatus, since a plurality of temperature reference values are set for the heating unit, the relationship between the magnitude of the respective values is determined for controlling the switching on or off of the heat source and the warning lamp. Therefore, the controlling of the temperature detecting circuit, the heat source, and the warning lamp becomes complicated and troublesome.

SUMMARY OF THE INVENTION

An object of the present invention is to provide a fixing apparatus capable of efficiently heating a fixing roller and supplying information required for controlling a temperature thereof in a simple manner.

Another object of the present invention is to provide a fixing apparatus capable of economically and efficiently heating the fixing roller, shortening a waiting time required before a fixing operation becomes possible, and lowering the energy consumption required for heating the fixing roller.

A further object of the present invention is to provide a fixing apparatus capable of detecting the temperature at or in the vicinity of the heating source by a simple temperature detecting means, to thereby easily control the operation of the heat source and the supply of temperature information.

To efficiently heat a plurality of rollers in a fixing apparatus according to the present invention, at least one of the rollers used for a fixing operation is provided with a hollow section wherein a heat source is provided at a position offset toward a section held between one roller and another roller, and upstream of the held section.

Furthermore, to ensure an easy control of a supply of temperature information, the fixing apparatus according to the present invention comprises: a detecting means for detecting the temperature at or in the vicinity of a heat source; a means for starting the operation of the heat source to raise the temperature thereof when the detected temperature is lower than a required temperature; a temperature information supplying means for supplying information that the temperature of the fixing apparatus has risen to the temperature required for the fixing operation, when the temperature has reached the required temperature; a timer means for counting from the start of the heat source operation means; a reset means for resetting the count value of the timer means when the temperature has risen to the required temperature; a temperature information supply continuing means for continuing the supply of temperature information regardless of the present temperature; and a stopping means for stopping the supply of temperature information when the count of the timer means reaches a predetermined value.

When the heat source is operated to start the radiation of heat, a part of the peripheral surface of the roller provided with the heat source therein near the section held between the roller and another roller corresponding to the former roller and upstream of the passage for conveying the print medium is closest to the heat source, and thus part of the peripheral surface has the highest temperature. Consequently, the temperature is highest at a part of the peripheral surface of the roller at which the conveyed print medium is first held at the time of the fixing operation, and as a result, the roller is efficiently and economically heated, and thus a waiting time before the fixing operation can be started is shortened and the energy required for heating the roller is lowered.

When the temperature at or in the vicinity of the heat source detected by the detecting means is lower than the required temperature, the heat source operating means starts the operation of the heat source and the count is started by the timer means. Thereafter, when the temperature detected by the detecting means has risen to the required temperature, the temperature information supplying means notifies an operator that the temperature has risen to a temperature required for the fixing operation, and at the same time, the reset means resets the timer means. The continuing means continues the supply of temperature information by the temperature information supplying means regardless of the temperature detected by the detecting means, but when the count of the timer means reaches a predetermined value, the stopping means stops the supply of temperature information. Namely, once notification is given of the ready state for the fixing operation, even if the temperature detected by the detecting means is lower than the required temperature, the notification of the ready state is continued until the count of the timer means, which starts to count from the start of the operation of the heat source, reaches a predetermined value.

As described above, one common specific temperature is used to determined whether or not the temperature is that required for the fixing operation, and whether or not the operation of the heat source has been started, and thus a simple constitution and easy control of the fixing apparatus is obtained. Furthermore, the temperature information supplying means for notifying the operator whether or not the fixing operation can be carried out does not immediately change the state of the notification thereof even if the temperature becomes lower than the required temperature, and the timer means functions to continue a stable supply of temperature information during the fixing operation. Accordingly, the operator is not troubled by meaningless changes in the notification of the ready state, and thus can carry out the work in an efficient manner.

BRIEF DESCRIPTION OF THE DRAWINGS

A preferred embodiment of the present invention will be described in detail with reference to the accompanying drawings, illustrating a laser printer embodying the present invention, in which.

DESCRIPTION OF THE PREFERRED EMBODIMENT

The present invention will be described in detail by way of an example of an application thereof to a laser printer, with reference to the drawings.

Figure 1:
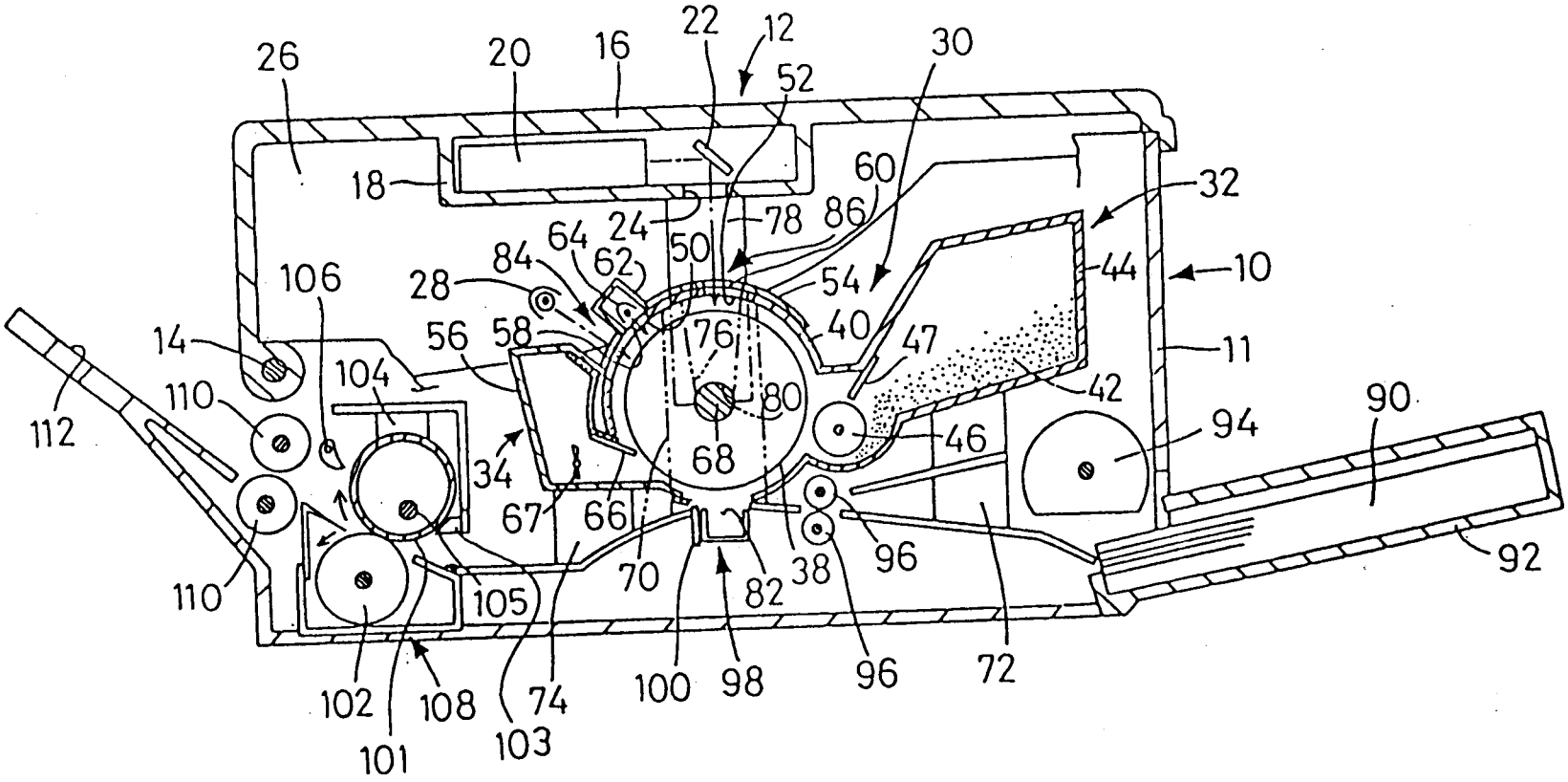
FIG. 1 is a front sectional view of a laser printer.

Referring to FIG. 1, a housing 11 of a main body 10 is provided with a cover 12 rotatable around a shaft 14 to thereby open the upper portion of the main body 10. A unit supporter 18 attached to the inside of the upper plate 16 of the main body 10 houses a laser scanner unit 20 (hereinafter referred to as a "unit") and a reflecting mirror 22. The unit 20 includes a semi-conductor laser for radiating laser beams, a collimator lens, a polygonal mirror and the like. As shown by a dashed line in the FIG. 1, the respective mirrors and lens are arranged in such a manner that a laser beam radiated from the unit 20 is reflected by the reflecting mirror 22 toward the inside of the main body 10, through a slit 24 formed in the unit supporter 18. A pre-exposure lamp 28 is disposed in a space between the side walls 26 of the cover 12.

A process cartridge 30 (hereinafter referred to as a "cartridge") is housed in the main body 10 and comprises a first casing 32 and a second casing 34. The first casing 32 comprises a cylindrical section 40 formed coaxially with and covering approximately 75% of the outer circumference of a photosensitive drum 38, a toner container 44 for containing a toner 42 therein, and a developing device or a developing roller 46 and a blade 47 interposed between the cylindrical section 40 and the toner container 44. Through holes 50 and 52 are formed at two points in the cylindrical section 40, to allow partial access to the photosensitive drum 38 thereat. The second casing 34 comprises another cylindrical section 54 formed coaxially with the cylindrical section 40 and covering the photosensitive drum 38, and a cleaner container 56. Through holes 58 and 60, opposed to the through holes 50 and 52 formed in the cylindrical section 40, are formed in the cylindrical section 54, respectively. Further, a hollow projection 62 having a charger 64 held therein is formed in the cylindrical section 54 in the longitudinal direction of the photosensitive drum 38. The cleaner container 56 contains a cleaner 66 which can be brought into contact with the peripheral surface of the photosensitive drum 38, and a guide blade 67.

The first casing 32 and the second casing 34, which are opposed to each other with the photosensitive drum 38 interposed therebetween, can be independently rotated around the rotary shaft 68 of the photosensitive drum 38, and the cylindrical section 40 and the cleaner container 56 can be separated from each other at the ends thereof to form an opening 82 under the photosensitive drum 38. The through holes 50 and 52 are designed to confront the corresponding through holes 58 and 60, respectively, to thereby form openings 84 and 86.

The housing 11 contains therein a pair of first supporters 70, a pair of second supporters 72, and a pair of third supporters 74, for supporting the cartridge 30 (only the respective supporters on one side are illustrated in FIG. 1). A guide groove 76, which increases in width toward the top thereof and supports the rotary shaft 68 at positions projected from the first and second casings 32 and 34, respectively, is formed in the first supporter 70. The second and third supporters 72 and 74 support the first and second casings 32 and 34, respectively, and the position and angle of the upper end surfaces thereof are determined in such a manner that they come into contact with the lower surfaces of the first and second casings 32 and 34, respectively, when the rotary shaft 68 is engaged with the bottom of the guide groove 76 formed in the first supporter 70. A pair of retaining plates 78 (only one thereof is illustrated in FIG. extending from the lower surface of the upper plate 16 toward the inside of the main body 10, with respect to the first supporter 70, are fixed in the cover 12, and semicircular notches 80 having the same diameter as that of the rotary shaft 68 are formed in the retaining plates 78 at the tips thereof. As shown in FIG. 1, each notch 80 is engaged with the rotary shaft 68 when the cover 12 covers the opening of the main body 10, so that the rotary shaft 68 is engaged with the bottom of the guide groove 76.

In this embodiment, as described above, the holding mechanisms for holding the cartridge 30 are constituted by the first, second, and third supporters 70, 72 and 74, and the retaining plates 78.

In addition to the above-mentioned components, as shown from right to left in FIG. 1, there are provided inside the main body 10 a cassette 92 for storing sheets of printing paper 90 therein, a pick-up roller 94, a pair of registration rollers 96, a transfer charger 98, a charge removing needle 100, a fixing apparatus 108 comprising a fixing roller 101 disposed on the drive side thereof, another fixing roller 102 disposed on the driven side thereof, a detector 103 for detecting a temperature in the vicinity of the fixing roller 101, a cleaner 104, a heater 105, a separating pawl 106, and a pair of paper discharging rollers 110, etc.

Figure 2:
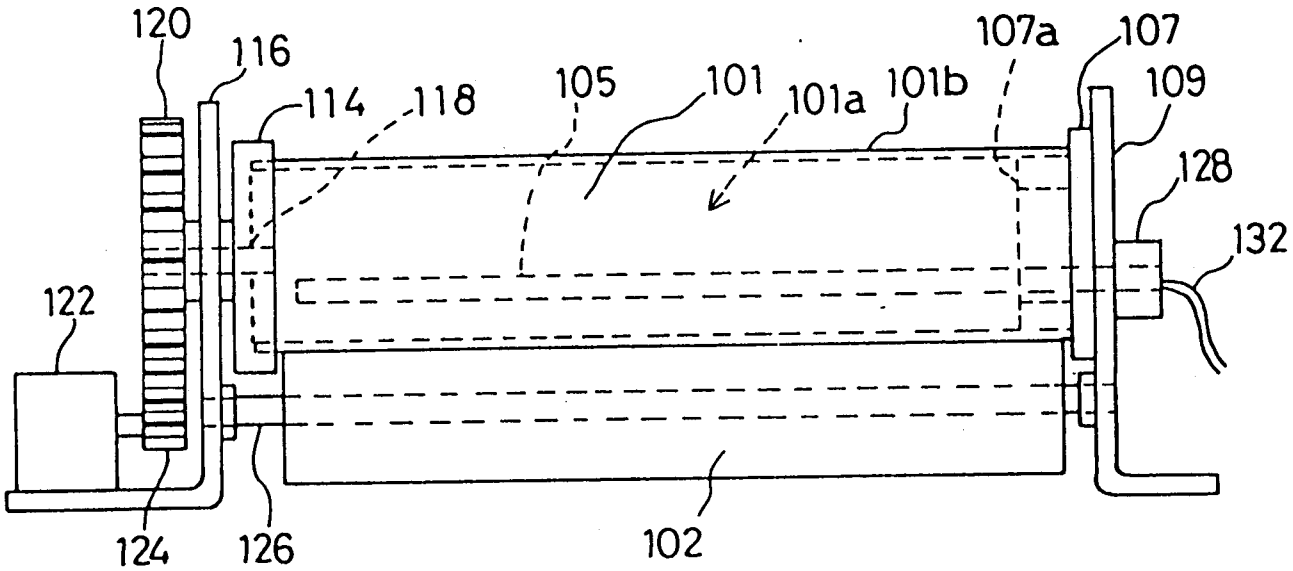
FIG. 2 is a side view of a fixing apparatus.

The peripheral surface **101*b* of the fixing roller 101 disposed inside the fixing apparatus 108 is made of highly heat-conductive aluminum and the roller 101 is hollow as shown in FIG. 2. The fixing roller 101 is rotatably supported at the right end thereof by engagement on a ring projection 107*a* projecting from a right roller retainer 107, which is fixed to a right guide 109, with the circumferential surface of the fixing roller 101. Further, the fixing roller 101 is fixed to a left roller retainer 114 and connected with a roller gear 120 at the left end thereof to be integrally rotatable therewith by a drive shaft 118 rotatably supported by a left guide 116. The roller gear 120 is meshed with a motor gear 124 driven by a motor 122, and accordingly, a rotation of the motor 122 causes a rotation of the fixing roller 101. The fixing roller 102 is also fixed to a rotary shaft 126 mounted axially through the center thereof and rotated integrally therewith. The rotary shaft 126 is positioned and rotatably supported by the right and left guides 109 and 116 in such a manner that the fixing roller 102 is rotated together with the rotation of the fixing roller 101 when the former comes into contact with the latter. The heater 105 extending in a longitudinal direction of the fixing roller 101 is inserted in the hollow portion 101*a* of the fixing roller 101 from the right end of the fixing roller 102 and positioned such that it is offset toward the fixing roller 102 and upstream of a section held between the fixing rollers 101 and 102. The right end of the heater 105 is fixed to the guide 109 by a fixing terminal 128, to be thus held in a specific position inside the hollow portion 101*a* regardless of the rotation of the fixing roller 101. The heater 105 is driven by electric power supplied from a well-known drive circuit 130 (FIG. 3) through a cable 132**.

Furthermore, a control circuit including a print substrate is disposed in the lower section of the main body 10, and the transfer of images to the print medium is effected by the execution of various control programs stored in the control circuit.

In the laser printer described above, the cartridge 30 is held inside the main body 10, the photosensitive drum 38 is partially opposed to the transfer charger 98 through the opening 82, and at the same time, each part of the photosensitive drum 38 is positioned such that it corresponds to the pre-exposure lamp 28, the charger 64, and the reflecting mirror 22 through the openings 84 and 86. Namely, upon starting the printing operation, light emitted from the pre-exposure lamp 28 is radiated through the opening 84 onto the photosensitive drum 38 at the peripheral surface thereof immediately upstream of the charger 64, and the charger 64 provides a primary charging of the photosensitive drum 38 via the opening 84. Thereafter, laser light passing from the unit 20 to the reflecting mirror 22 is radiated onto the photosensitive drum 38, from the slit 24 through the opening 86, followed by an exposure, and thus the toner 42 in the first casing 32 is developed.

The papers 90 are taken out one by one from the cassette 92 by the pick-up roller 94, and after a paper supply timing has been adjusted by the registration rollers 96, the paper 90 is fed between the transfer charger 98 and the photosensitive drum 38. At this stage, a developed image on the photosensitive drum 38 is transferred to the paper 90, and then the paper 90 is separated from the photosensitive drum 38 by the charge removing needle 100 and fed to the fixing apparatus 108.

In the fixing apparatus 108, the paper 90 is conveyed by the two fixing rollers 101 and 102, which rotate in the directions shown by arrows in FIG. 1, respectively. During this conveyance, heat radiated from the heater 105 is applied to the paper 90 via the peripheral surface of the fixing roller 101.

As explained above, the heater 105 is offset toward the fixing roller 102, upstream of the section held between the fixing rollers 101 and 102, and thus the heat radiated from the heater 105 is concentrated at the circumferential surface of the fixing roller 101 which comes into closest contact with the paper 90 conveyed from the photosensitive drum 38. Namely, the speed of the temperature elevation of the fixing roller 101 at the peripheral surface thereof to a temperature required for a fixing operation is greatly increased, and thus an efficient printing operation can be started without delay. This combination of heat and pressure firmly fixes the toner image transferred from the peripheral surface of the photosensitive drum 38 to the paper 90, to thereby provide a permanent visible image. Upon completion of the fixing process in the fixing apparatus 108, the paper 90 is discharged to a discharging unit 112 by a pair of paper discharging rollers 110.

After the image transfer, the surface of the photosensitive drum 38 in the second casing 34 is cleaned by the cleaner 66.

The control of the operation of the heater 105 is described in detail with reference to FIGS. 3 through 5.

Figure 3:
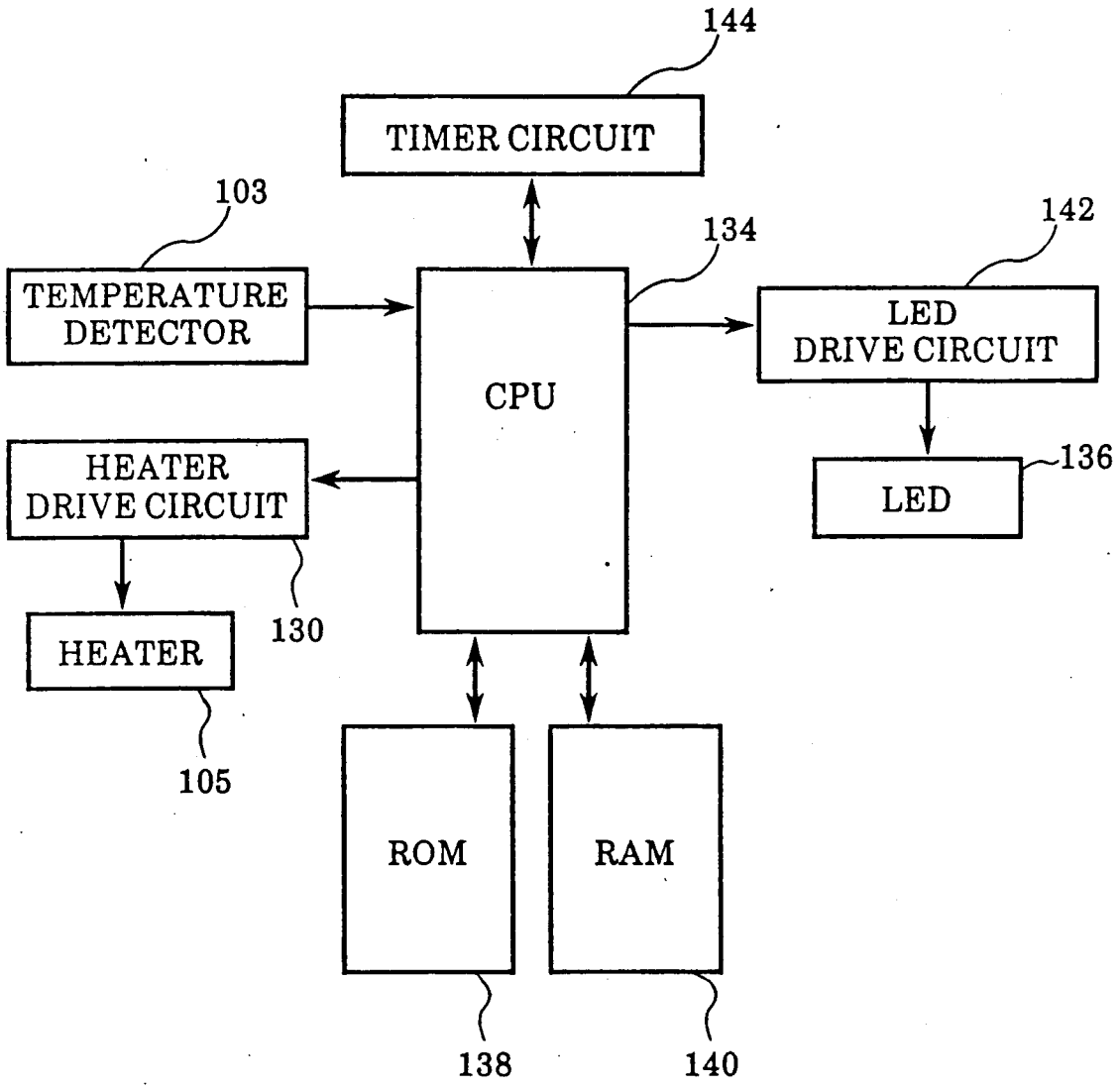
FIG. 3 is a block diagram showing the control of the operation of a heater used as a heat source and a light emitting diode serving as a warning lamp.

As shown in FIG. 3, a central processing unit 134 (hereinafter, abbreviated to "CPU") is connected to a ROM 138 holding the programs required for the control of the operation of the heater 105, a light emitting diode 136 (hereinafter termed "LED") which lights when a temperature of the fixing roller 101 at the peripheral surface thereof is that required for the fixing operation, and a RAM 140 through which the operation of each process is carried out. The LED 136 is connected to the CPU 134 through an LED drive circuit 142. Further, the CPU 134 is connected to a timer circuit 144 for controlling the LED 136, to the heater 105 disposed in the fixing apparatus 108 through a heater drive circuit 130, and to a temperature detector 103 for detecting a temperature of the peripheral surface of the fixing roller 101 heated by the heater 105. The temperature detector 103 is a well-known type which converts temperature fluctuations into voltage fluctuations, using a thermistor.

Figure 4:
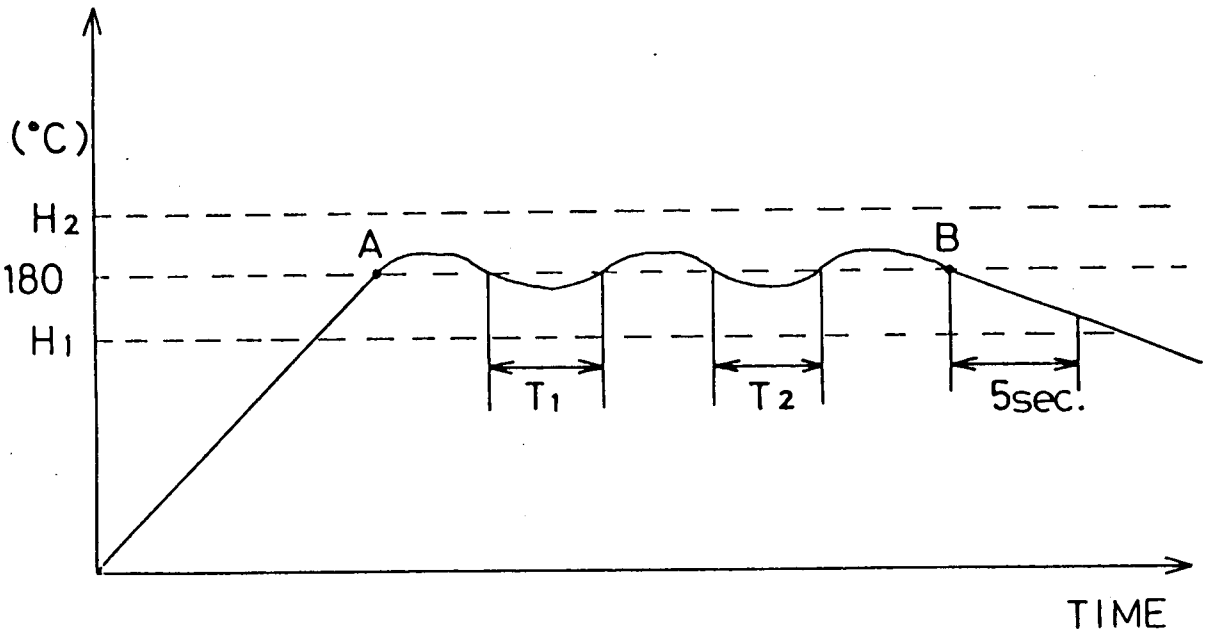
FIG. 4 is a graph showing the relationship between a time and a temperature for explaining the control of the operation of the heater.
Figure 5:
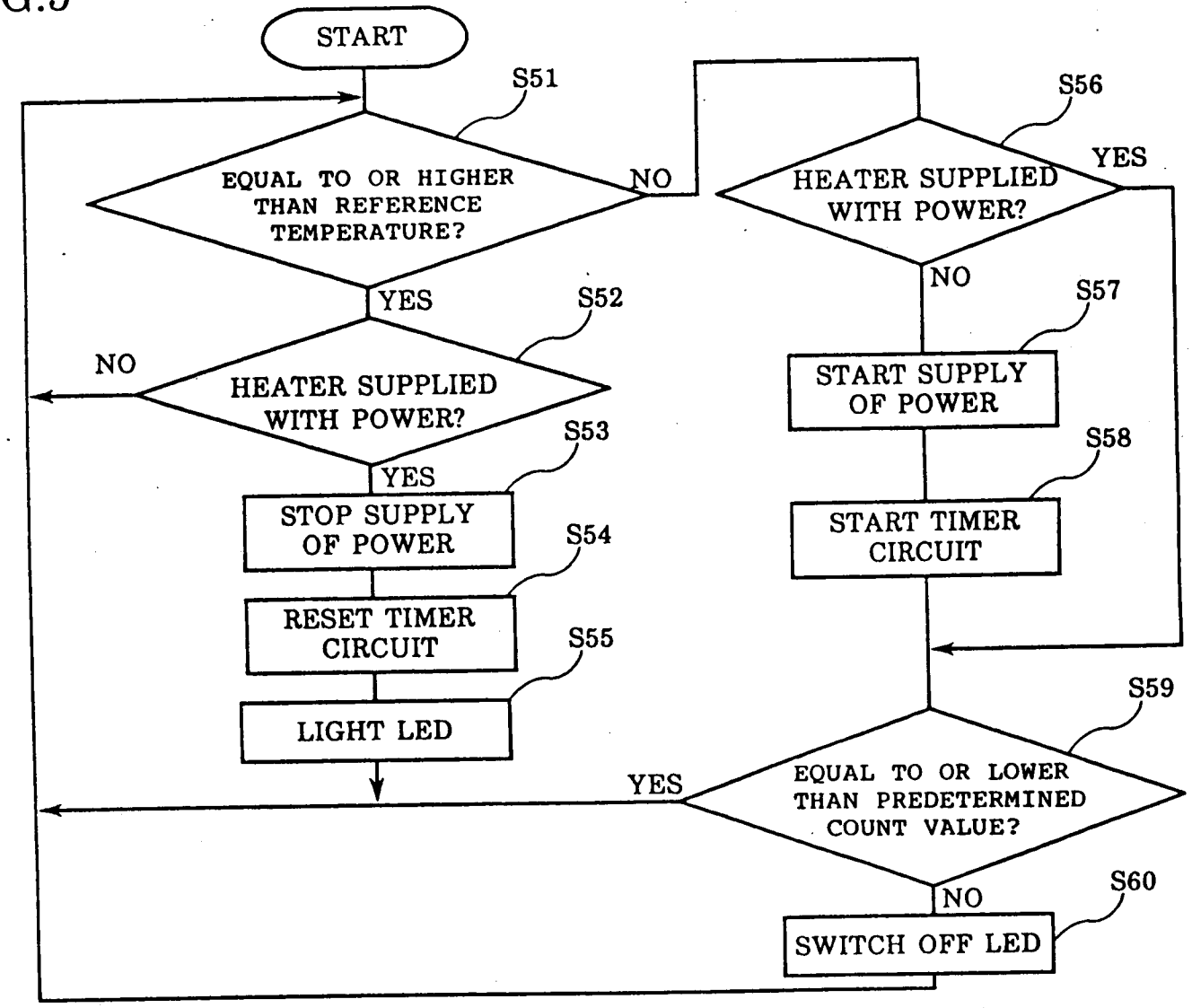
FIG. 5 is a flowchart showing the control of the operation of the heater.

After the power supply of the laser printer is turned on, when the temperature at the peripheral surface of the fixing roller 101 has risen to a reference temperature required for a stable fixing operation, as shown by a point A in FIG. 4, the operation of the heater 105 is controlled to hold the fixing temperature at or in the vicinity of the reference temperature, by the processes illustrated in FIG. 5.

First, at step 51 (hereinafter "S51", as for all other steps), it is determined whether or not the temperature at the peripheral surface of the fixing roller 101 is equal to or higher than the reference temperature, on the basis of a signal output by the temperature detector 103. The reference temperature is set at a temperature required for the fixing operation in accordance with the kind of toner 42 used. In the temperature detector 103 of this embodiment, the reference temperature is set at 180° C. At S51, if the temperature at the peripheral surface of the fixing roller 101 is determined to be not lower than the reference temperature, the process goes to S52.

At S52, it is determined whether or not the heater 105 for heating the fixing roller 101 should be supplied with electric power from the heater drive circuit 130. If the heater 105 is inoperative and does not require a supply of electric power, the process returns to S51 and the temperature at the peripheral surface of the fixing roller 101 is monitored.

On the other hand, at S52, if the heater 105 is operative, the process goes to S53 and the supply of the electric power for the heater 105 is stopped. Then, at S54, the timer circuit 144 is reset.

At S55, the LED 136 is lit to show that the peripheral surface of the fixing roller 101 is at a temperature fitting for the fixing operation. The process then returns to S51, where the temperature at the peripheral surface of the fixing roller 101 is monitored, and the control of the electric power supply for the heater 105 is continued.

As apparent from the above-described processes of S51 to S55, when the temperature at the peripheral surface of the fixing roller 101 is equal to or higher than the reference temperature, the operation of the heater drive circuit 130 is stopped, to thereby prevent a further electric power supply for the heater and to reset the timer circuit 144.

At S51, if the temperature at the peripheral surface of the fixing roller 101 has not reached the reference temperature, the process goes to S56 and it is determined whether or not the heater 105 is supplied with the electric power, namely operative. If the heater 105 is not operative, the process goes to S57 and the operation of the heater 105 is started. Then, at S58, the timer circuit 144 starts to count, and at S59, it is determined whether or not the count of the timer circuit 144 is equal to or lower than a predetermined value. In the present embodiment, the predetermined value is set at 5 seconds.

If the count has not reached the predetermined value, the process returns to S51 and the temperature at the peripheral surface of the fixing roller 101 is monitored. As shown in FIG. 4, during a normal operation of the laser printer, durations of times $T_1$ and $T_2$ when the temperature at the peripheral surface of the fixing roller 101 is lower than the reference temperature, are both less than 5 seconds.

At S59, if the count of the timer circuit 144 is higher than the predetermined value, the process goes to S60. Note, if the count of the timer circuit 144 is higher than the predetermined value, namely, 5 seconds, as illustrated from point B in FIG. 4, an abnormality has occurred in the operation of the laser printer. Consequently, at S60, the LED 136 is switched off to notify the operator that the temperature at the peripheral surface of the fixing roller 101 is not fit for the fixing operation. Therefore, the process returns to S51, and the temperature at the peripheral surface of the fixing roller 101 is monitored.

At S56, if it is determined that the heater 105 is operative, as the count at the timer circuit 144 has already started, the process jumps to S59 and it is determined whether or not the count of the timer circuit 144 is equal to or lower than the predetermined value as described above.

As can be understood from the processes S56 through S60, even though it is determined that the temperature at the peripheral surface of the fixing roller 101 is lower than the reference temperature, the LED 136 indicating that the temperature is fit for the fixing operation is not switched immediately off. Namely, after it is determined the temperature at the peripheral surface of the fixing roller 101 is lower than the reference temperature, the operation of the heater 105 is started and the LED 136 remains lit for a time usually required for reaching the reference temperature. In addition, as shown in FIG. 4, although the temperature at the peripheral surface of the fixing roller 101 fluctuates between points higher or lower than the reference temperature, as long as the operation of the laser printer can normally work, the reference temperature and the predetermined value compared with the count of the timer circuit 144 are set such that the fixing operation can be carried out within the range of from $H_1$ °C. to $H_2$ °C., as shown in FIG. 4.

In this embodiment, if the LED 136 is lit, the operator knows that the peripheral surface of the fixing roller 101 is at a temperature at which the fixing operation can be carried out, but an acoustic means such as a buzzer or the like also can be used for the same purpose.

Moreover, although in the fixing apparatus of the foregoing embodiment the heater 105 is mounted inside the fixing roller 102, the present invention is applicable also to a fixing apparatus wherein the heater is spaced from the fixing roller, to enable the control of the operation of the heater and the control of the supply of temperature information for the device.

What is claimed is:

1. A fixing apparatus for fixing an image on a recording medium comprising:

a heat source for providing heat to the recording medium and fixing the image on the recording medium;

a heat source drive means for driving the heat source;

a detecting means for detecting the temperature in the vicinity of the heat source;

a drive control means for starting the operation of the heat source drive means to raise the temperature of the heat source when the detected temperature is lower than a temperature desired for the fixing operation;

a visual or auditory temperature information supplying means for supplying information that the temperature of the fixing apparatus has risen to the temperature desired for the fixing operation;

a timer means for counting the lapse of time after the detecting means detects a temperature lower than said desired temperature;

a reset means for resetting the count value of the timer means when the temperature has risen to the temperature desired for the fixing operation;

a temperature information supply continuing means for continuing operation of the temperature information supply means after the temperature detected by the detecting means has fallen to a temperature below said desired temperature; and a stopping means for stopping the supply of the temperature information when the count of the timer means reaches a predetermined value.

2. A fixing apparatus according to claim 1, and further comprising a pair of fixing rollers for engaging opposed surfaces of said recording medium and, wherein at least one of said pair of fixing rollers is provided with a hollow section in which the heat source is located.

3. Apparatus for controlling a heated machine element comprising:

means for heating said machine element;

means for sensing the temperature of said element;

means responsive to said sensing means for controlling said heating means;

visual or auditory signalling means for signalling that the temperature of the machine element is at a predetermined temperature;

means for disabling said visual or auditory signalling means when said machine element is below said predetermined temperature; and means for preventing the disabling means from disabling said visual or auditory signalling means for a predetermined period of time after the temperature of said machine element sensed by said sensing means falls below said predetermined temperature.

4. Apparatus as in claim 3, wherein said signaling means includes means for warning of an abnormal state of said heating means when said disabling means disables said visual or auditory signaling means.

5. Apparatus as in claim 3, wherein said preventing means comprises a counter and means for starting the counter when the sensing means senses a temperature below said predetermined temperature.

6. Apparatus as in claim 3, wherein said machine element is an image fixing roll.

7. Apparatus for fixing an image on a recording medium comprising:

a housing;

means for defining a feed path for said recording medium;

a roll rotatably mounted on the housing with a peripheral surface of the roll disposed in said feed path to engage a surface of said recording medium;

a heating means for heating the peripheral surface;

heater mounting means for mounting said heating means adjacent said peripheral surface at a region upstream of the region at which said peripheral surface engages said recording medium surface;

means for sensing the temperature of said region of peripheral surface;

means responsive to said sensing means for controlling said heating means;

visual or auditory signalling means for signalling that the temperature of said region of the peripheral surface of the roll is at a predetermined temperature;

means for disabling said visual or auditory signalling means when said machine element is below said predetermined temperature; and means for preventing the disabling means from disabling said visual or auditory signalling means for a predetermined period of time after the temperature of said region sensed by said sensing means falls below said predetermined temperature.

8. Apparatus as in claim 7, wherein said preventing means comprises a counter and means for starting the counter when the sensing means senses a temperature below said predetermined temperature.

9. Apparatus as in claim 7, wherein said roll has a hollow portion and the heating means is disposed at a position within said hollow portion offset toward the feed path and wherein the sensing means is positioned to sense the temperature of said region of the peripheral surface.

* * * * *